United States Patent [19]

Staerzl

[11] 4,280,465

[45] Jul. 28, 1981

[54] THROTTLE CONTROL FOR AN ELECTRONIC FUEL-INJECTION CONTROL CIRCUIT

[75] Inventor: Richard E. Staerzl, Fond du Lac, Wis.

[73] Assignee: Brunswick Corporation, Skokie, Ill.

[21] Appl. No.: 169,365

[22] Filed: Jul. 16, 1980

[51] Int. Cl.[3] ..... F02B 3/00

[52] U.S. Cl. ..... 123/494; 123/488

[58] Field of Search ..... 123/488, 492, 494

[56] References Cited

U.S. PATENT DOCUMENTS

| | | | |
|---|---|---|---|
| 3,765,380 | 10/1973 | Rachel | 173/494 |
| 3,908,614 | 9/1975 | Ironside | 173/494 |
| 4,051,818 | 10/1977 | Volchers | 173/494 |
| 4,123,729 | 10/1978 | Buetemeister | 173/494 |

*Primary Examiner*—Ronald B. Cox

*Attorney, Agent, or Firm*—Hopgood, Calimafde, Kalil, Blaustein & Judlowe

[57] ABSTRACT

The invention contemplates an electrical network associated with a throttle-control potentiometer whereby a standard commercially available linear potentiometer having an given angle of electrical-resistance variation may be employed, over an entire lesser angle range of throttle rotation, to provide an output voltage which, for an initial fraction of throttle displacement, is a predetermined substantially linear variation of a given input voltage, and which, for the remaining fraction of throttle displacement, remains substantially constant at the level of the upper end of the linearly varying fraction. A feature of the invention is that the slope and extent of linear variation are selectable, without modification of the linear potentiometer.

8 Claims, 5 Drawing Figures

THROTTLE CONTROL FOR AN ELECTRONIC FUEL-INJECTION CONTROL CIRCUIT

BACKGROUND OF THE INVENTION

The invention relates to a potentiometer-type throttle for an electronic fuel-injection control circuit for an internal-combustion engine, as of the variety described in my copending U.S. patent application, Ser. No. 120,467, filed Feb. 11, 1980. Reference is made to said application for greater descriptive detail of a fuel-injection engine, to which the present invention is illustratively applicable.

In fuel-injection control circuits of the character indicated, it has been considered necessary to design a particularly characterized throttle-control potentiometer, unique to the mechanical angle of the throttle-adjustment range and providing both (a) a linearly varying response and (b) an unvarying response over two successive fractions of the range of throttle displacement. Not only are such characterized potentiometers expensive, but they must be designed uniquely for the requirements of each engine size, type and intended manner of use—e.g., for relatively rich mixtures in a racing environment, vis-a-vis relatively lean mixtures in a cruising environment.

BRIEF STATEMENT OF THE INVENTION

It is an object of the invention to provide an improved throttle-control potentiometer means of the character indicated.

Another object is to provide circuit means associated with a linear potentiometer whereby the non-linear overall response needed for throttle control in an electronic fuel-injection system may be achieved without modifying the potentiometer.

A further object is to achieve the foregoing objects using a standard commercially available linear potentiometer, even though the range of throttle displacement may be less than the range of resistance variation inherent in the potentiometer.

A still further object is to achieve the foregoing objects with circuitry which is adaptable to the unique fuel-mixture requirements of a variety of sizes, styles and uses of different fuel-injected engines.

Still another object is to achieve the above objects with circuitry which enables use of the same standard commercial linear potentiometer to serve the fuel-mixture requirements of a variety of engines.

A general object is to provide substantial economy, enhanced reliability and versatility, in throttle-control means for an electronic fuel-injection system.

The invention achieves the foregoing objects and certain further features by utilizing a network which includes a linear potentiometer and an amplifier such that in a first fractional range of potentiometer adjustment input voltage is tracked linearly up to an amplified maximum, which matches the level of the input voltage; beyond this point, the remaining fraction of potentiometer adjustment is ineffective to increase output voltage beyond said maximum.

DETAILED DESCRIPTION

The invention will be described in detail, in conjunction with the accompanying drawings, in which.

Figure 1:
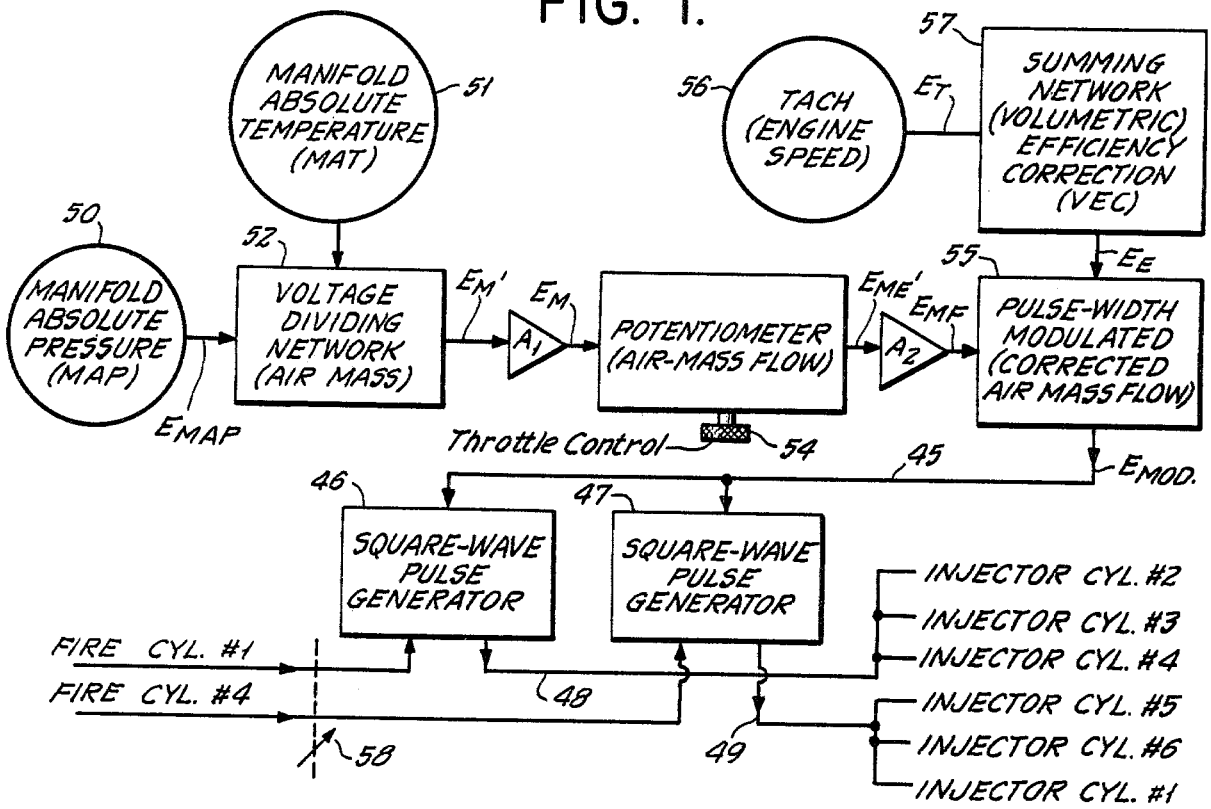
FIG. 1 is a diagram schematically showing components of an electronic fuel-injection control system for an internal-combustion engine.

In said copending patent application, a fuel-injection internal-combustion engine is described in which one or more square-wave pulse generators drive solenoid-operated injectors unique to each cylinder, there being a single control system whereby the pulse-generator means is modulated as necessary to accommodate throttle demands in the context of engine speed and other factors. FIG. 1 herein is adopted from said application, for purposes of simplified contextual explanation.

The control system of FIG. 1 is shown in illustrative application to a two-cycle six-cylinder 60-degree V-engine wherein injectors for cylinders #2, #3 and #4 are operated simultaneously and (via line 48) under the control of the pulse output of a first square-wave generator 46, while the remaining injectors (for cylinders #5, #6 and #1) are operated simultaneously and (via line 49) under the control of the pulse output of a second such generator 47. The base or crankshaft angle for which pulses generated at 46 are timed is determined by ignition-firing at cylinder #1, and pulses generated at 47 are similarly based upon ignition-firing at cylinder #4, i.e., at 180 crankshaft degrees from cylinder #1 firing. The actual time duration of all such generated pulses will vary in response to a control signal ($E_{MOD.}$), supplied in line 45 to both generators 46–47.

The circuit to produce the modulating-voltage $E_{MOD.}$ operates on various input parameters, in the form of analog voltages which reflect air-mass flow for the current engine speed, and a correction is made for volumetric efficiency of the particular engine. More specifically, for the circuit shown, a first electrical sensor 50 of manifold absolute pressure is a source of a first voltage $E_{MAP}$ which is linearly related to such pressure, and a second electrical sensor 51 of manifold absolute temperature may be a thermistor which is linearly related to such temperature through a resistor network 52. The voltage $E_{MAP}$ is divided by the network 52 to produce an output voltage $E_M$, which is a linear function of instantaneous air mass or density at inlet of air to the engine. A first amplifier $A_1$ provides a corresponding output voltage $E_M$ at the high-impedance level needed for regulation-free application to the relatively low impedance of potentiometer means 53, having a selectively variable control that is symbolized by a throttle knob 54. The voltage output $E_{MF}$, of potentiometer means 53, reflects a "throttle"-positioned pick-off voltage and thus reflects instantaneous air-mass flow, for the instantaneous throttle (54) setting, and a second amplifier $A_2$ provides a corresponding output voltage $E_{MF}$ for regulation-free application to one of the voltage-multiplier inputs of a pulse-width modulator 55, which is the source of $E_{MOD.}$ already referred to.

The other voltage-multiplier input of modulator 55 receives an input voltage $E_E$ which is a function of engine speed and volumetric efficiency. More specifically, a tachometer 56 generates a voltage $E_T$ which is linearly related to engine speed (e.g., crankshaft speed, or repetition rate of one of the spark plugs), and a summing network 57 operates upon the voltage $E_T$ and certain other factors (which may be empirically determined, and which reflect volumetric efficiency of the particular engine size and design) to develop the voltage $E_E$ for the multiplier of modulator 55.

Figure 5:
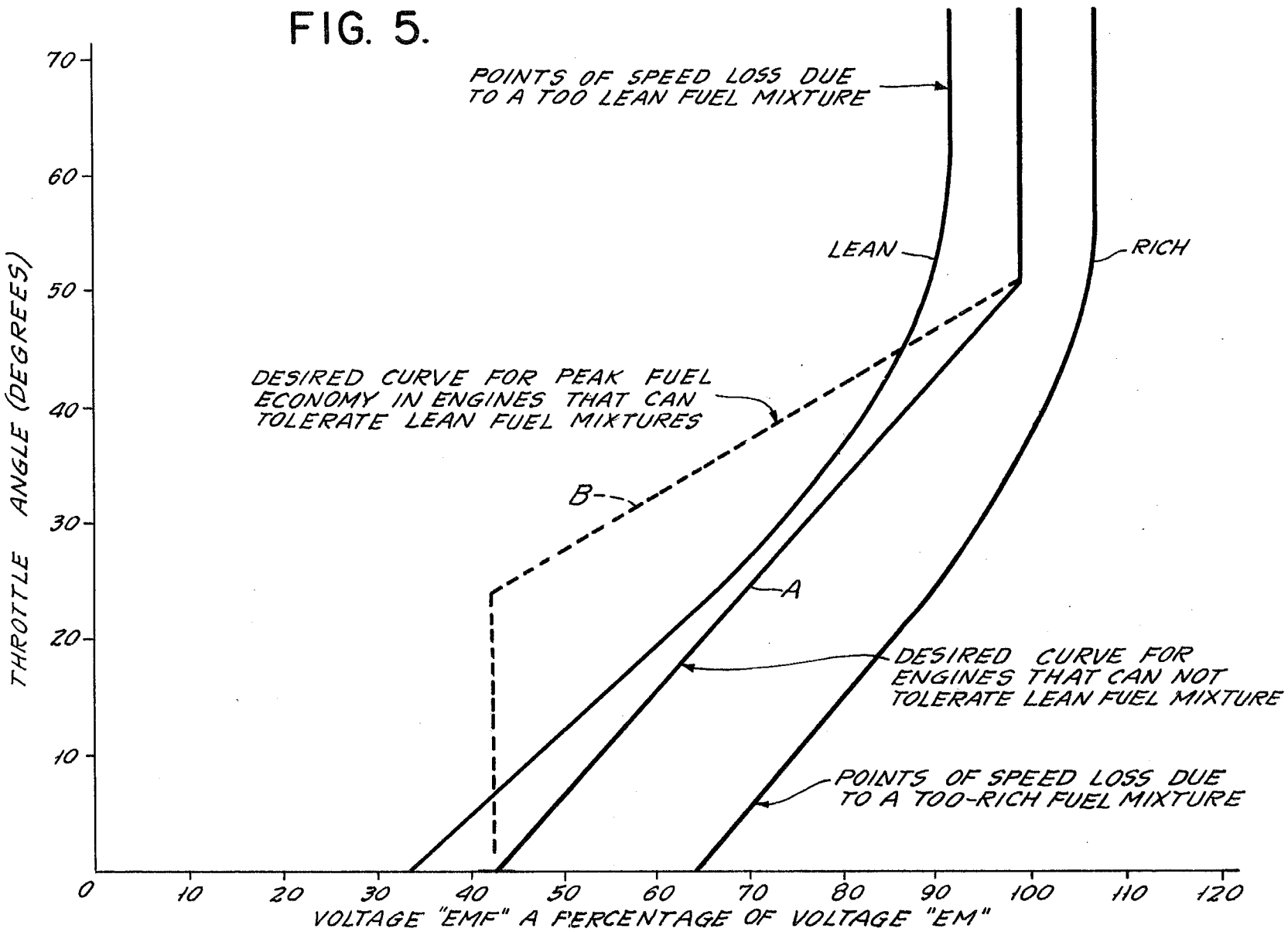
FIG. 5 is a graphical presentation of performance of circuits of FIGS. 2 to 4, as a function of throttle-angle displacement.

The present invention is concerned with the nature and performance of potentiometer means 53. Desired performance is presented in FIG. 5, in terms of output voltage ($E_{MF}$,) as a percentage of input voltage ($E_M$) over a 75-degree range of throttle-position angles, the 75-degree position being indicated as "W.O.T.", meaning the wide-open position of throttle 54. The particular engine is shown to operate generally in a range which extends between a "LEAN" limit curve and a "RICH" limit curve, and legends in FIG. 5 explain that these limits are taken for points at which speed loss occurs on the respective lean and rich sides of operation at any given throttle setting. A solid-line curve (A) displays one type of desired performance of potentiometer means 53 wherein a sloped linear first fraction of throttle 54 displacement (e.g., from 0° to 50°) occurs within the indicated LEAN-RICH spread, being on the lean side in the 20° to 35° range throttle-angle settings which govern economy or cruising operation of the engine. Beyond cruising, greater throttle-angle settings call for more-enriched mixture until the 50° setting, at which point the output voltage $E_{MF}$, is 100% of (i.e., equal to) the input voltage $E_M$; beyond the 50° setting, further advance of throttle 54 is ineffective to increase the output voltage $E_{MF}$,.

Figure 2:
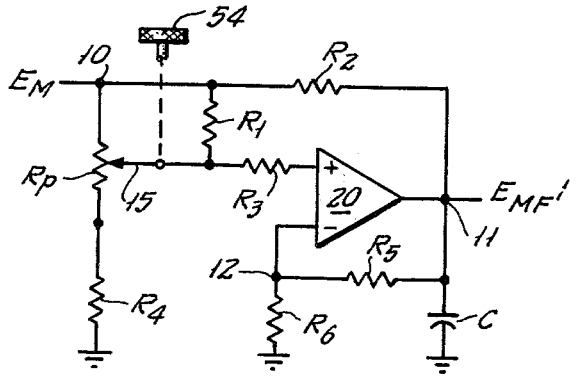
FIGS. 2, 3 and 4 are similar diagrams to show different embodiments of potentiometer circuitry for one of the components of FIG. 1.

The circuit of FIG. 2 achieves the A-curve performance noted above in connection with FIG. 5, without requiring that the potentiometer component be specially characterized to develop the knee of the curve. Simply stated, a commercially available linear potentiometer $R_p$ is selected to have a range of electrical adjustability (e.g., 90 degrees) which is at least as great as the engine-limited range of throttle adjustment, illustratively shown in FIG. 5 as 75 degrees. The full resistance of potentiometer $R_p$, together with such additional fixed series resistance ($R_4$) as may be appropriate, is connected across the input-circuit connections of means 93, here shown to comprise an input-signal pole 10 and a ground connection, with potentiometer $R_p$ connected to pole 10.

A voltage divider comprising resistors $R_5$ and $R_6$ is similarly connected across the output-circuit connections of means 93, here shown to comprise an output-signal pole 11 and a ground connection, a voltage-dividing tap 12 being available at the connection of resistors $R_5$ and $R_6$. A bridging resistor $R_2$ interconnects the signal poles 10–11 and is of resistance value very substantially less than that of either of resistors $R_5$–$R_6$. Voltage-comparator means 20 has two input terminals and an output terminal, the latter being connected to the output-signal pole 11. Legends at 20 identify the negative input terminal connected to tap 12 and the positive input terminal connected to the wiper arm 15 of potentiometer $R_p$, and arm 15 is shown to be mechanically positioned by the throttle control 54. A resistor $R_3$ is serially included in the connection of arm 15 to comparator 20 and is the parallel value of $R_5$ and $R_6$ to assure substantial uniformity of current flow (i.e., to assure against any substantial disparity of current flow) in the respective input-circuit connections to comparator 20.

The comparator 20 is suitably a commercially available unit, such as the National Semiconductors product designated LM-2901, and it is in FIG. 2 used in a non-inverting operational amplifier configuration, so that the overall gain of the circuit will never exceed unity. A resistor $R_1$, of resistance value substantially exceeding all other resistors, spans the arm 15 connection and the input-signal pole 10, thereby insuring that the non-inverting comparator terminal is tied to a high potential in the event of loss of wiper-arm (15) contact with the potentiometer substrate; this $R_1$ connection allows the circuit to fail rich at part throttle and to maintain proper calibration at larger throttle openings. A capacitor C is used for frequency compensation, in the indicated situation of employing a comparator as an operational amplifier. Typical values for the indicated circuit elements are: $R_p$=2 kilohms, $R_1$=1 megohm, $R_2$=1 kilohm, $R_3$=100 kilohms, $R_4$=1.6 kilohms, $R_5$=100 kilohms, $R_6$=460 kilohms, and C=0.47 μf.

Typically, input-signal voltage $E_M$ is approximately 3 volts, and the non-inverting nature of comparator 20 assures a maximum output voltage $E_{MF}$, at the instantaneous level of input voltage $E_M$, i.e., for upper (greater-throttle) positions of arm 15. When arm 15 is at its lowest position, it samples approximately 44% of the instantaneous input voltage for application to the positive input of comparator 20; this sampled voltage is amplified by comparator 20, the gain of which is controlled by the feedback network of $R_5$ and $R_6$, yielding an output voltage $E_{MF}$, of about 1.3 volts. With advancing positions of throttle control 54, the voltage $E_{MF}$, (11) approaches that of $E_M$ (10), and attenuation reduces as a substantially linear function of arm (15) position, until the voltage at arm (15) multiplied by the amplifier gain is equal to $E_M$ (at the 50° position, in the present example), thus ending the linearly varying fraction of the curve A. For sampled voltages beyond this point (i.e., throttle angles from 50° to W.O.T.), the inability of the comparator (20) to source current prevents $E_{MF}$ from exceeding the value of $E_M$; therefore, there is no change in output voltage.

It will be seen that in the described circuit of FIG. 2, the slope of the inclined fraction of curve A is dependent upon the selected resistance values of $R_4$ in relation to the portion of $R_p$ to be used throughout the range of throttle positions. It is also seen that the relation of resistance at $R_5$ to that at $R_6$ determines the "knee" point of curve A transition, from substantially linearly varying, to unvarying.

Figure 3:
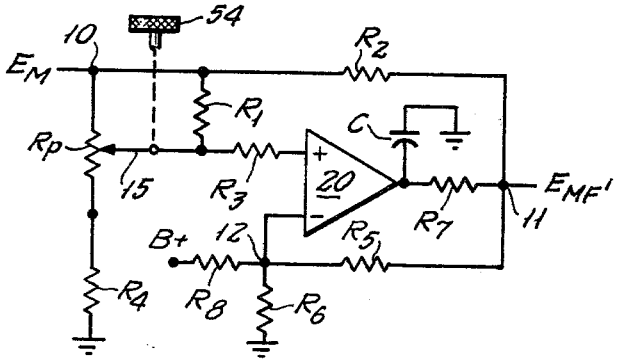

FIG. 3 illustrates a modification in which a greater slope offset is achievable for the linearly varying fraction of curve A. All circuit components of FIG. 2 are to be found in FIG. 3, with the same reference numbers, but FIG. 3 achieves the additional slope offset by imposing a fixed bias upon the tap 12 connection to comparator 20. Such bias is shown imposed by a high resistance element $R_8$ (typically 1 megohm) in the connection of tap 12 to a B+ supply (e.g., 8 volts). At the same time, a relatively low resistance element $R_7$ connects comparator (2) to the output-signal pole 11. Resistor $R_7$ should be selected such that the particular engine will idle smoothly for the low-throttle limit of potentiometer $R_p$. The circuit of FIG. 3 performs as described for FIG. 2, except that its function follows curve B to provide more lean mixtures throughout the 0° to 50° range of throttle (54) settings; beyond this point, no change in output voltage $E_{MF}$, results, for increasing throttle (54) settings.

Figure 4:
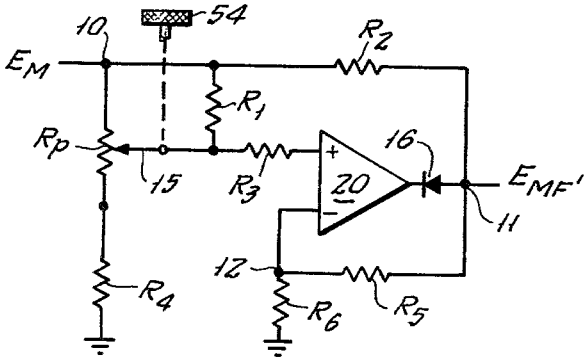

FIG. 4 will be recognized for its resemblance to FIG. 2, the only change being that in the event of using an operational amplifier 20', in place of comparator 20, a diode 16 is included in the output connection to pole 11.

Diode 16 allows amplifier 20' to sink only, thus duplicating the described action of comparator 20. While there is technical difference, in that diode 16 will increase the minimum possible value of $E_{MF}$, by 0.7 volt, this is in most cases not a problem.

It will be understood that what has been said as to amplifier 20' and diode 16, as a replacement for the comparator 20 of FIG. 2, will also apply for similar substitution for the comparator 20 of FIG. 3.

The described invention will be seen to meet all stated objects, enabling a standard linear potentiometer to selectively produce particular performance such as curve A or curve B, merely by choice of fixed resistance values where indicated. Not only is slope or offset selectable, but so also is the "knee" point of curve positioning, in relation to total angle of throttle positioning. Also, the indicated results are achievable even though the angular range of the standard potentiometer $R_p$ exceeds the angular range of throttle adjustment.

While the invention has been described in detail for preferred and illustrative embodiments, it will be understood that modification may be made without departure from the claimed scope of the invention.

What is claimed is:

1. In an electronic fuel-injection control circuit for an internal-combustion engine, wherein the output of a voltage source is variably tapped by a potentiometer to derive a throttle-controlling voltage for controlled generation of an injector-operating pulse of duration reflecting instantaneous amplitude of the throttle-controlling voltage, the improvement wherein the potentiometer is part of a network having (a) input-connection means having a signal pole adapted for source-voltage connection and (b) output-connection means having a signal pole for delivery of throttle-controlling voltage, a first resistor and the full resistance of said potentiometer series-connected across said input-connection means with one end of the potentiometer resistance connected to the signal pole of said input-connection means, voltage-dividing resistor means having an intermediate tap and connected across said output-connection means, a second resistor interconnecting said signal poles, said second resistor being of very much lower resistance than either of the tap-defined fractions of said voltage dividing means, said potentiometer having a throttle-control wiper arm selectively movable to variably tap a fraction of the source voltage, comparator means having an output connection to the signal pole of said output-connection means and having two input connections adapted for differential response to separate voltages to be compared, one of said input connections being connected to said arm and the other of said input connections being connected to said tap, whereby the voltage-dividing placement of said tap may provide a predetermined modification of the curve of output-connection voltage change in respect of source voltage as a function of wiper-arm displacement.

2. The improvement of claim 1, in which said comparator means is used as a non-inverting amplifier.

3. The improvement of claim 1, in which said comparator means comprises an operational amplifier and a diode in the output connection thereof to the signal pole of said output-connection means.

4. The improvement of claim 1, in which the resistance components of said voltage-dividing means are selected such that the intermediate tap thereof establishes a voltage level greater than that selected for the minimum variable-tap position of said potentiometer.

5. The improvement of claim 4, in which said first resistor is of such resistance value in relation to the total resistance value of said potentiometer as to establish a minimum potentiometer-sampled voltage which is in the order of 40 percent of an applied input-connection voltage, whereby the range of voltage at said output-connection means will vary between substantially 40 percent and 100 percent of applied input-connection voltage.

6. The improvement of claim 1, in which biasing means including a d-c source is connected to the intermediate tap of said voltage-dividing resistor means.

7. The improvement of claim 6, in which said d-c source connection is characterized by a resistance value which is greater than either component of said voltage-dividing resistor means.

8. The improvement of claim 7, in which a third resistor is in the output connection of said comparator means to said output-signal pole.

* * * * *